US009190009B2

(12) United States Patent
Zhu et al.

(10) Patent No.: US 9,190,009 B2
(45) Date of Patent: Nov. 17, 2015

(54) DATA DRIVING CIRCUIT HAVING SIMULATION BUFFER AMPLIFIER OF LCD PANEL, LCD PANEL AND LCD DEVICE

(71) Applicant: SHENZHEN CHINA STAR OPTOELECTRONICS TECHNOLOGY CO., LTD, Shenzhen (CN)

(72) Inventors: Jiang Zhu, Shenzhen (CN); Dongsheng Guo, Shenzhen (CN)

( * ) Notice: Subject to any disclaimer, the term of this patent is extended or adjusted under 35 U.S.C. 154(b) by 215 days.

(21) Appl. No.: 14/111,554

(22) PCT Filed: Jul. 11, 2013

(86) PCT No.: PCT/CN2013/079216

§ 371 (c)(1),
(2) Date: Oct. 13, 2013

(87) PCT Pub. No.: WO2015/003363

PCT Pub. Date: Jan. 15, 2015

(65) Prior Publication Data

US 2015/0015560 A1 Jan. 15, 2015

(30) Foreign Application Priority Data

Jul. 9, 2013 (CN) ..... 2013 1 0286821

(51) Int. Cl.
*G09G 3/36* (2006.01)

(52) U.S. Cl.
CPC ..... *G09G 3/3696* (2013.01)

(58) Field of Classification Search
CPC ..... G09G 3/3685
USPC ..... 345/100
See application file for complete search history.

(56) References Cited

U.S. PATENT DOCUMENTS

| | | | | |
|---|---|---|---|---|
| 8,552,960 | B2 * | 10/2013 | Tsuchi | 345/100 |
| 2007/0290980 | A1 * | 12/2007 | Lin et al. | 345/100 |
| 2011/0157120 | A1 | 6/2011 | Hasegawa et al. | |
| 2012/0161661 | A1 | 6/2012 | Cho et al. | |

FOREIGN PATENT DOCUMENTS

| | | | |
|---|---|---|---|
| CN | 1848232 | A | 10/2006 |
| CN | 101310322 | A | 11/2008 |
| CN | 101510761 | A | 8/2009 |
| CN | 101551983 | A | 10/2009 |
| CN | 102157127 | A | 8/2011 |
| CN | 102956174 | A | 3/2013 |
| KR | 20100129628 | A | 12/2010 |

OTHER PUBLICATIONS

Jiang Yingting, the International Searching Authority written comments, Apr. 2014, CN.

* cited by examiner

*Primary Examiner* — Roy Rabindranath

(57) ABSTRACT

A data driving circuit of a liquid crystal display (LCD) panel includes a data driving chip and at least two isolation driving units. The data driving chip includes a plurality of data driving units that drive data lines of the LCD panel, and the data driving unit includes a port that limits a range of a working voltage of the data driving unit. The isolation driving unit outputs a preset reference voltage to the port of the data driving unit.

9 Claims, 3 Drawing Sheets

DATA DRIVING CIRCUIT HAVING SIMULATION BUFFER AMPLIFIER OF LCD PANEL, LCD PANEL AND LCD DEVICE

TECHNICAL FIELD

The present disclosure relates to the field of liquid crystal displays (LCDs), and more particularly to a data driving circuit of an LCD panel, the LCD panel, and an LCD device.

BACKGROUND

As shown in FIG. 1, a liquid crystal display (LCD) panel includes data lines and a data driving chip 30 that drives the data lines. The data driving chip 30 often employs a data driving unit 21 coupled to the data line to amplify driving ability of a signal, and the data driving unit 21 is configured with a first port and a second port, where a range of working voltage of the data driving unit 21 is determined by voltages input to the first port and the second port. Generally, a constant voltage is input to one of two ports of the data driving unit 21, and the constant voltage is regarded as a first reference voltage. Voltage input to a signal unit arranged external to the data driving chip 30 outputs voltage to the other port of the data driving unit 21, and the voltage is regarded as a second reference voltage. The second reference voltage directly affects stability of a data driving circuit, thus, the second reference voltage output by the signal unit is input to the data driving unit 21 through an isolation driving unit 10. The isolation driving unit 10 not only avoids load disturbance of the data driving unit 21 affecting, the signal unit of an input end of the data driving chip, but also improves driving ability of the second reference voltage. A typical method causes overheat of the data driving chip 30.

SUMMARY

The aim of the present disclosure is to provide a data driving circuit of a liquid crystal display (LCD) panel, the LCD panel, and a liquid crystal display (LCD) device capable of avoiding overheat of a data driving chip and increasing working life of the data driving chip.

The aim of the present disclosure is achieved by the following method.

A data driving circuit of the LCD panel comprises data driving chip and at least two isolation driving units. The data driving chip comprises a plurality of data driving unit that drives data lines of the LCD panel, and the data driving unit comprises a port that limits a range of a working voltage of the data driving unit. The isolation driving unit outputs a preset reference voltage to the port of the data driving unit.

Furthermore, a driving unit comprises two adjacent data driving units, where each of the driving units comprises a first data driving unit having, positive polarity and a second data driving unit having negative polarity. A port of the first data driving unit comprises a first port and a second port, and a port of the second data driving unit comprises a first port and a second port. Each of the driving units corresponds to one isolation driving unit, and an output end of each of the isolation driving units is coupled to the second port of the first data driving unit and the first port of the second data driving unit. This is a method of two data driving units together using one isolation driving unit.

Furthermore, the data driving circuit of the LCD panel further comprises a first reference voltage, a second reference voltage, and a third reference voltage. A value of the first reference voltage, a value of the second reference voltage, and a value of the third reference voltage successively increase. The value of the second reference voltage is equal to an average value of a sum of the first reference voltage and the third reference voltage, and the preset reference voltage output by the isolation driving unit is the second reference voltage. As an input voltage of the data driving unit increases, power loss of the data driving unit correspondingly increases. In order to reduce the power loss of the data driving unit, LC molecules are driven using a polarity inversion method, where a column inversion and a dot inversion method are common. Characteristics of the column inversion and the dot inversion are two adjacent data lines having opposite polarity voltage, where one of two adjacent data lines is odd data line, and the other data line is even data line. Namely, the polarity inversion is obtained through the data line driven by switching the data driving unit. The polarity of the data driving unit used is constant, and the working voltage of the data driving unit is in a corresponding polarity range that corresponds to the positive polarity and the negative polarity of the data driving unit. Namely, if polarity of the data driving unit is positive, the working voltage of the data driving unit is in a range of a positive polarity, if polarity of the data driving unit is negative, the working voltage of the data driving unit is in a range of a negative polarity. Thus, the power loss of the data driving unit is small. In the present disclosure, the second reference voltage HVDDA is used, the working voltage of the first data driving unit having the positive polarity is between the third reference voltage VDDA and the second reference voltage HVDDA, the working voltage of the second data driving unit having, the negative polarity is between the second reference voltage HVDDA and the first reference voltage VSSA. The first reference voltage VSSA usually is a ground voltage, thus, the second reference voltage HVDDA is about a half of the third reference voltage VDDA, the second reference voltage HVDDA usually is named half-voltage.

Furthermore, the isolation driving unit is integrated with the data driving chip, which improves integration level of the data driving circuit and simplifies structure of the data driving circuit.

Furthermore, the isolation driving unit comprises a simulation buffer amplifier, and an output end of the simulation buffer amplifier is coupled to the data driving unit. The preset reference voltage is input to a first input end of the simulation buffer amplifier, and a second input end of the simulation buffer amplifier is coupled to the output end of the simulation buffer amplifier. This is a circuit structure of the isolation driving unit using the simulation buffer amplifier.

Furthermore, the data driving unit comprises a simulation buffer amplifier, an output end of the simulation buffer amplifier is coupled to a switching unit, and the simulation buffer amplifier is coupled to two adjacent data lines through the switching unit. A driving signal of the data line is sent to a first input end of the simulation buffer amplifier, and a second input end of the simulation buffer amplifier is coupled to the output end of the simulation buffer amplifier. This is a circuit structure of the data driving unit using the simulation buffer amplifier.

Furthermore, a driving unit comprises two adjacent data driving units, each of the driving units comprises a first data driving unit having positive polarity and a second data driving unit having negative polarity. Each of the driving units corresponds to one isolation driving unit, and an output end of each of the isolation driving units is coupled to the second port of the first data driving unit and the first port of the second data driving unit.

The data driving circuit of the LCD panel further comprises a first reference voltage, a second reference voltage, and a third reference voltage. A value of the first reference voltage, a value of the second reference voltage, and a value of the third reference voltage successively increase. The value of the second reference voltage is equal to an average value of a sum of the first reference voltage and the third reference voltage. The preset reference voltage output by the isolation driving unit is the second reference voltage, and the first reference voltage is voltage of a ground end of the data driving circuit of the LCD panel.

The first data driving unit comprises a first simulation buffer amplifier, and the second data driving unit comprises a second simulation buffer amplifier. Output ends of the first simulation buffer amplifier and the second simulation buffer amplifier are coupled to a switching unit, and the simulation buffer amplifier is coupled to two adjacent data, lines through the switching unit. A driving signal of the data line is sent to first input ends of the first simulation buffer amplifier and the second simulation buffer amplifier, a second input end of the first simulation buffer amplifier is coupled to an output end of the first simulation buffer amplifier, and a second input end of the second simulation buffer amplifier is coupled to an output end of the second simulation buffer amplifier.

the isolation driving unit comprises a third simulation buffer amplifier, an output end of the third simulation buffer amplifier is coupled to a second port of the first simulation buffer amplifier and a first port of the second simulation buffer amplifier. The second reference voltage is input to a first input end of the third simulation buffer amplifier, and a second input end of the third simulation buffer amplifier is coupled to the output end of the third simulation buffer amplifier.

This is circuit structures of the isolation driving unit and the data driving unit, which employ the simulation buffer amplifier. As an input voltage of the simulation buffer amplifier increases, power loss of the simulation buffer amplifier correspondingly increases. In order to reduce the power loss of the simulation buffer amplifier, LC molecules are driven using a polarity inversion method, where a column inversion and a dot inversion methods are commonly used. Characteristics of the column inversion and the dot inversion are two adjacent data lines having opposite polarity voltage, where one of two adjacent data lines is odd data line, and another data line is even data line. Namely, the polarity inversion is obtained through the data line driven by switching the simulation buffer amplifier. The polarity of the simulation buffer amplifier used is constant, and the working voltage of the simulation buffer amplifier is in a corresponding polarity range that corresponds to the polarity of the simulation buffer amplifier. Namely, if polarity of the simulation buffer amplifier is positive, the working voltage of the simulation buffer amplifier is in a range of a positive polarity, if polarity of the simulation buffer amplifier is negative, the working voltage of the simulation buffer amplifier is in a range of a negative polarity. Thus, the power loss of the simulation buffer amplifier is small. In the present disclosure, the second reference voltage HVDDA is used, the working voltage of the first simulation buffer amplifier having the positive polarity is between the third reference voltage VDDA and the second reference voltage HVDDA, the working voltage of the second simulation buffer amplifier having the negative polarity is between the second reference voltage HVDDA and the first reference voltage VSSA. The first reference voltage VSSA usually is a ground voltage, thus, the second reference voltage HVDDA is about a half of the third reference voltage VDDA, the second reference voltage HVDDA usually is named half-voltage.

Furthermore, the data driving circuit of the LCD panel further comprises a gamma correction circuit, where the gamma correction circuit outputs the second reference voltage to the third simulation buffer amplifier. The second reference voltage HVDDA is directly output by a typical gamma correction circuit, namely the second reference voltage HVDDA is generated from a typical gamma voltage, which simplifies design and reducing production costs. A load driven by the second reference voltage HVDDA directly affects stability of the gamma voltage of an input end of the isolation driving unit, thus, the third simulation buffer amplifier is used to reduce influence of the load.

A liquid crystal display (LCD) panel comprises a data driving circuit of the LCD panel of the present disclosure.

A liquid crystal display (LCD) device comprises a liquid crystal display (LCD) panel of the present disclosure.

It should be understood that each of the data lines is connected with the data driving unit, and each of the data driving units needs the preset reference voltage provided by the isolation driving unit. The isolation driving unit needs a great direct-current (DC) because of a plurality of data lines of the LCD panel, thus, the isolation driving unit generates great heat, and temperature of an area comprising the isolation driving unit rises a lot, which causes overheat of the data driving chip, thereby reducing working life of the data driving chip. The present disclosure employs at least two isolation driving units, as a number of the isolation driving unit increases, power of each of the isolation driving units reduces, and heat generated by each of the isolation driving units correspondingly reduces. Thus, heat is uniformly dispersed to each of the isolation driving units, which solves overheat of a typical data driving chip, and increasing working life of the data driving chip.

DETAILED DESCRIPTION

Figure 1:
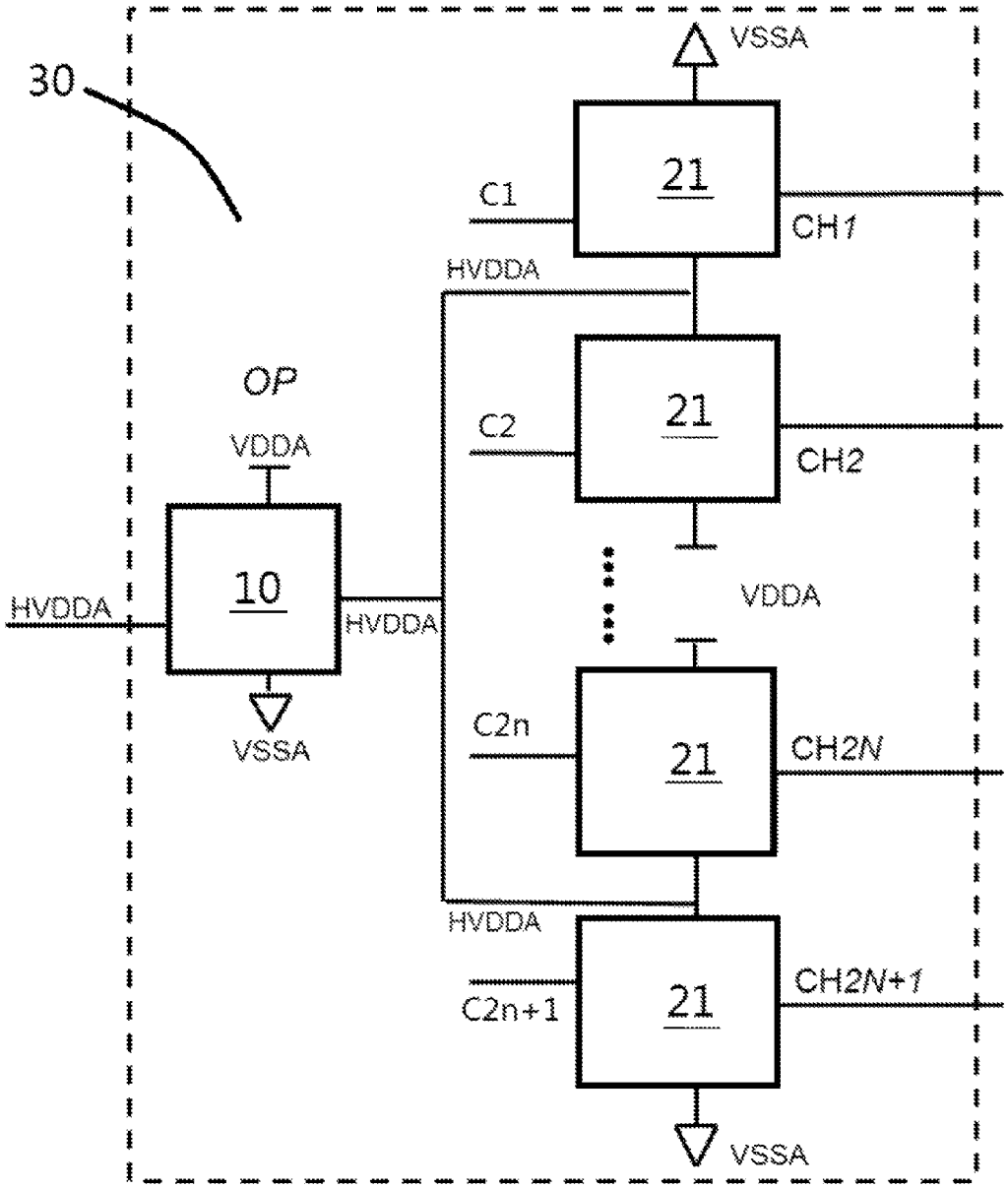
FIG. 1 (PRIOR ART)
FIG. 1 is a schematic diagram of a data driving circuit of a typical liquid crystal display (LCD) panel.
Figure 2:
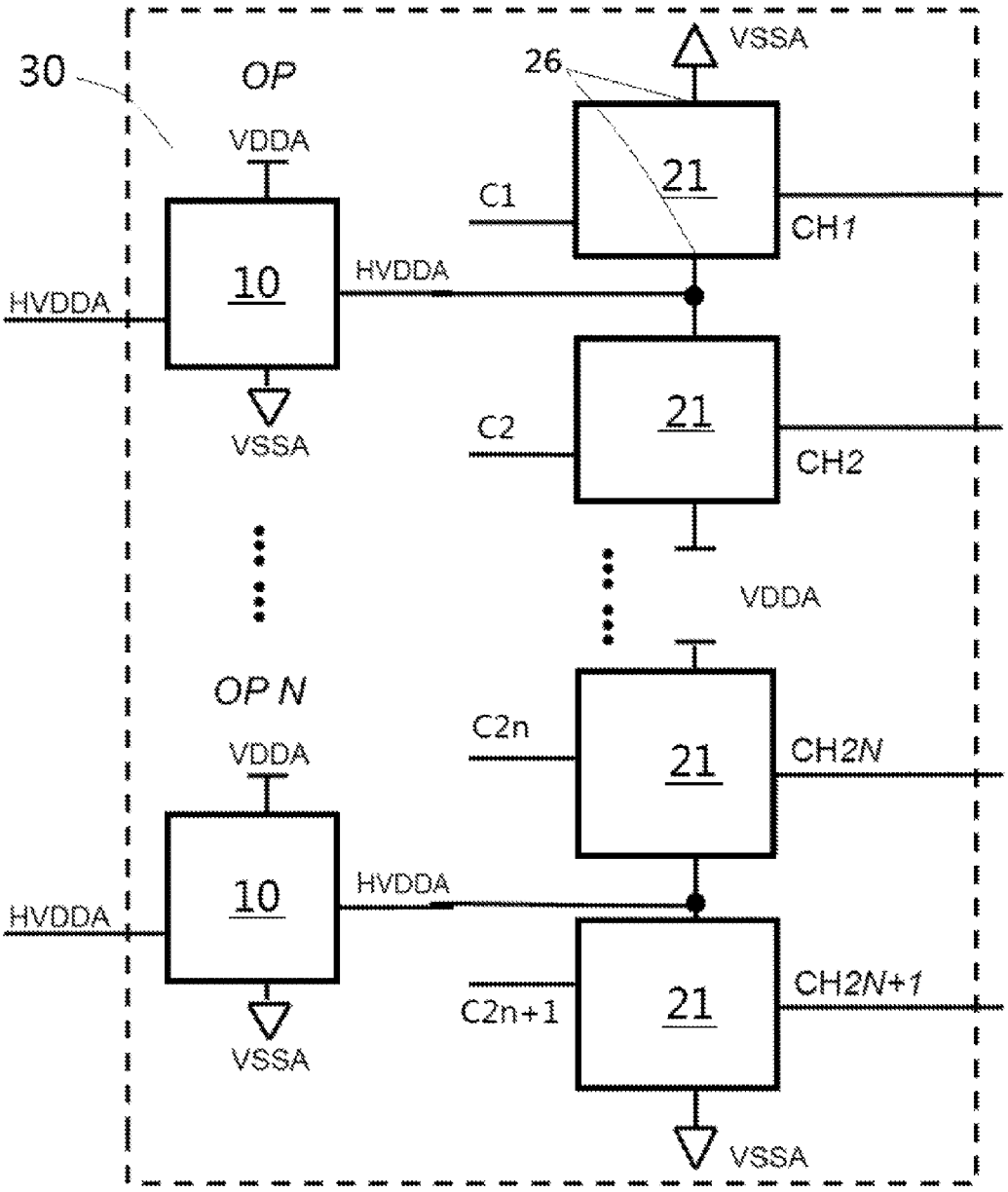
FIG. 2 is a schematic diagram of a data driving circuit of a liquid crystal display (LCD) panel of the present disclosure.

The present disclosure provides a liquid crystal display (LCD) device comprising a liquid crystal display (LCD) panel and a backlight unit that provides a light source for the LCD panel. The LCD panel comprises scan lines and data lines that crisscross each other, and the data lines is connected with a data driving circuit of the LCD panel. As shown in FIG. 2, the data driving circuit of the LCD panel comprises a data driving chip 30, where the data driving chip 30 comprises a plurality of data driving units 21 that drive the data lines of the LCD panel, and the data driving unit 21 comprises a port 26 that limits a range of a working voltage of the data driving unit 21. The data driving circuit of the LCD panel further comprises at least two isolation driving units 10, where the isolation driving unit 10 outputs a preset reference voltage to the port 26 of the data driving unit 21. The isolation driving unit 10 may be integrated with the data driving chip 30, or be arranged external to the data driving chip 30.

It should be understood that each of the data lines is connected with the data driving unit 21, and each of the data driving units 21 needs the preset reference voltage provided by the isolation driving unit 10. The isolation driving unit 10 needs a great direct-current (DC) because of a plurality of data lines of the LCD panel, thus, the isolation driving unit 10 generates great heat, and temperature of an area comprising the isolation driving unit 10 rises a lot, which causes overheat of the data driving chip 30, thereby reducing working life of the data driving chip. The present disclosure employs at least two isolation driving units 10, as a number of the isolation driving unit 10 increases, power of each of the isolation driving units 10 reduces, and heat generated by each of the isolation driving units correspondingly reduces. Thus, heat is uniformly dispersed to each of the isolation driving units, which solves overheat of a typical data driving chip, and increasing the working life of the data driving chip.

The present disclosure will further be described in detail in accordance with the figures and the exemplary examples.

Figure 3:
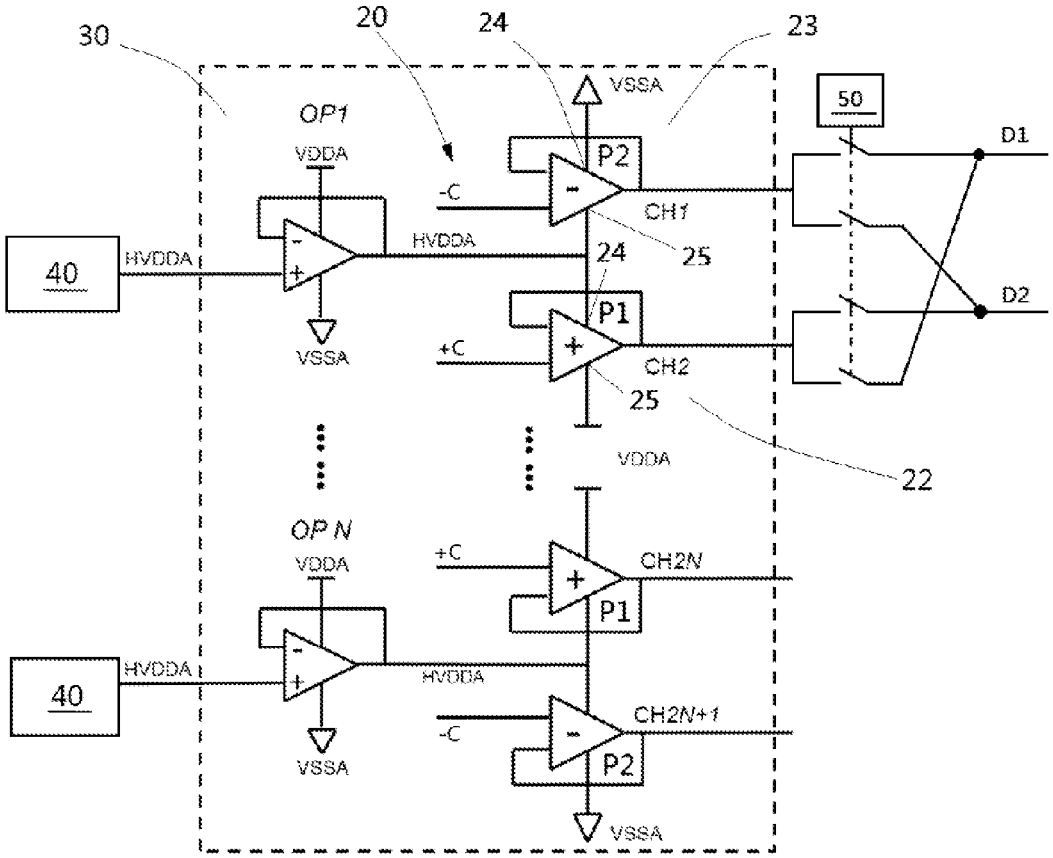
FIG. 3 is a schematic diagram of a data driving circuit of a liquid crystal display (LCD) panel of n example of the present disclosure.

As shown in FIG. 3, in an example, the data driving circuit of the LCD panel comprises the data driving chip 30, where the data driving chip 30 comprises a plurality of data driving units 21 that drive data lines of the LCD panel. A driving unit 20 comprises two adjacent data driving units 21, namely each of the driving units 20 comprises a first data driving unit 22 having positive polarity and a second data driving unit 23 having negative polarity. A port of the first data driving, unit 22 comprises a first port 24 and a second port 25, and a port of the second data driving unit 23 comprises a first port 24 and a second port 25.

Each of the driving units 20 corresponds to one isolation driving unit 10, and an output end of each of the isolation driving units 10 is coupled to the first port 24 of the first data driving unit 22 and the second port 25 of the second data driving unit 23, namely the first port 24 of the first data driving unit 22 is connected with the second port 25 of the second data driving unit 23. The data driving circuit of the LCD panel comprises a first reference voltage VSSA, a second reference voltage HVDDA, and a third reference voltage VDDA. A value of the first reference voltage VSSA, a value of the second reference voltage HVDDA, and a value of the third reference voltage VDDA successively increase, and the value of the second reference voltage HVDDA is equal to an average value of a sum of the first reference voltage VSSA and the third reference voltage VDDA. The preset reference voltage output by the isolation driving unit 10 is the second reference voltage HVDDA, and the first reference voltage VSSA is a voltage of a ground terminal of the data driving circuit of the LCD panel.

The first data driving unit 22 comprises a first simulation buffer amplifier P1, and the second data driving unit 23 comprises a second simulation buffer amplifier P2. Output ends of the first simulation buffer amplifier P1 and the second simulation buffer amplifier P2 are coupled to a switching unit 50, and the simulation buffer amplifier is coupled to two adjacent data lines D1/D2 through the switching unit 50. A driving signal of the data line is sent to first input ends of the first simulation buffer amplifier P1 and the second simulation buffer amplifier P2, a second input end of the first simulation buffer amplifier P1 is coupled to an output end of the first simulation buffer amplifier P1, and a second input end of the second simulation buffer amplifier P2 is coupled to an output end of the second simulation buffer amplifier P2. The driving signal of the data line is transferred to a corresponding data line at equal multiplying power by the first simulation buffer amplifier P1 and the second simulation buffer amplifier P2. The driving signal of the data line sent to the first input end of the first simulation buffer amplifier P1 is +C, and a range of +C is between the third reference voltage VDDA and the second reference voltage HVDDA. The driving signal of the data line sent to the first input end of the second simulation buffer amplifier P2 is −C, and a range of −C is between the second reference voltage HVDDA and the first reference voltage VSSA. Conversion sequence of logical operation of the switching unit 50 is consistent with inversion time sequence of a pixel capacitor. Current driving signal is +C, and is sent the data line D1 through the switching unit 50, when polarity inverses, a new driving signal +C is switched to the data line D2 by the switching unit 50. In a same way, the current driving signal is −C, and is sent to the data line D2 through the switching unit 50, when the polarity inverses, a new driving signal −C is switched to the data line D1 by the switching unit 50.

The isolation driving unit 10 comprises a third simulation buffer amplifier (OP1-OPN), an output end of the third simulation buffer amplifier is coupled to a first port 24 of the first simulation buffer amplifier P1 and a second port 25 of the second simulation buffer amplifier P2. The second reference voltage HVDDA is input to a first input end of the third simulation buffer amplifier, and a second input end of the third simulation buffer amplifier is coupled to the output end of the third simulation buffer amplifier.

These are circuit structures of the isolation driving unit 10 and the data driving unit 21 that employ the simulation buffer amplifier. As an input voltage of the simulation buffer amplifier increases, power loss of the simulation buffer amplifier correspondingly increases. In order to reduce the power loss of the simulation buffer amplifier, LC molecules are driven using a polarity inversion method, where a column inversion and a dot inversion methods are commonly used. Characteristics of the column inversion and the dot inversion are two adjacent data lines having opposite polarity voltage, where one of two adjacent data lines is an odd data line, and the other data line is an even data line. Namely, the polarity inversion is obtained through the data line driven by switching the simulation buffer amplifier. The polarity of the simulation buffer amplifier used is constant, and the working voltage of the simulation buffer amplifier is in a corresponding polarity range that corresponds to the positive polarity and the negative polarity of the simulation buffer amplifier. Namely, if the polarity of the simulation buffer amplifier is positive, the working voltage of the simulation buffer amplifier is in a range of a positive polarity, if polarity of the simulation buffer amplifier is negative, the working voltage of the simulation buffer amplifier is in a range of a negative polarity. Thus, the power loss of the simulation buffer amplifier is small. In the present disclosure, the second reference voltage HVDDA is used, the working voltage of the first simulation buffer amplifier P1 having the positive polarity is between the third reference voltage VDDA and the second reference voltage HVDDA, the working voltage of the second simulation buffer amplifier P2 having the negative polarity is between the second reference voltage HVDDA and the first reference voltage VSSA. The first reference voltage VSSA usually is a ground voltage, thus, the second reference voltage HVDDA is about a half of the third reference voltage VDDA, the second reference voltage HVDDA usually is named half-voltage.

The data driving circuit of the LCD panel comprises a gamma correction circuit 40, where the gamma correction circuit 40 outputs the second reference voltage HVDDA to the third simulation buffer amplifier. The second reference voltage HVDDA is directly output by a typical gamma correction circuit, namely the second reference voltage HVDDA is generated from a typical gamma voltage, winch simplifies design and reducing production costs. A load driven by the second reference voltage HVDDA directly affects stability of the gamma voltage of an input end of the isolation driving unit, thus, the third simulation buffer amplifier is used to reduce influence of the load.

It should be understood that the third simulation buffer amplifier corresponds to the data driving unit match one by one. As the number of the third simulation buffer amplifier increases, heat dissipation capability improved, and the cost correspondingly increases. Thus, the number of the third simulation buffer amplifier may be adjusted according to the heat dissipation capability and the costs.

It should be considered that other signals can be sent to the second input end of the third simulation buffer amplifier, which optionally adjusts amplification factor of an output voltage of the third simulation buffer amplifier.

The isolation driving unit also employs other active power equipment, as long as a signal of the input end of other active power equipment hardly affected by changing load of an output end of the other active power equipment.

The present disclosure is described in detail in accordance with the above contents with the specific exemplary examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

We claim:

1. A data driving circuit of a liquid crystal display (LCD) panel, comprising:

a data driving chip; and at least two isolation driving units;

wherein the data driving chip comprises a plurality of data driving units that drive data lines of the LCD panel, and the data driving unit comprises a port that limits a range of a working voltage of the data driving unit; each the isolation driving unit outputs a preset reference voltage to the port of the data driving unit;

wherein a driving unit comprises two adjacent data driving units, each of the driving units comprises a first data driving unit having a positive polarity and a second data driving unit having a negative polarity; each of the driving units corresponds to one isolation driving unit, and an output end of each of the isolation driving units is coupled to the first port of the first data driving unit and the second port of the second data driving unit;

the data driving circuit of the LCD panel further comprises a first reference voltage, a second reference voltage, and a third reference voltage; a value of the first reference voltage, a value of the second reference voltage, and a value of the third reference voltage successively increase; the value of the second reference voltage is equal to an average value of a sum of the first reference voltage and the third reference voltage; the preset reference voltage output by the isolation driving unit is the second reference voltage, and the first reference voltage is voltage of a around end of the data driving circuit of the LCD panel;

the first data driving unit comprises a first simulation buffer amplifier, and the second data driving unit comprises a second simulation buffer amplifier; output ends of the first simulation buffer amplifier and the second simulation buffer amplifier are coupled to a switching unit, and the simulation buffer amplifier is coupled to two adjacent data lines through the switching unit; a driving signal of the data line is sent to first input ends of the first simulation buffer amplifier and the second simulation buffer amplifier, a second input end of the first simulation buffer amplifier is coupled to an output end of the first simulation buffer amplifier, and a second input end of the second simulation buffer amplifier is coupled to an output end of the second simulation buffer amplifier;

the isolation driving unit comprises a third simulation buffer amplifier, an output end of the third simulation buffer amplifier is coupled to a second port of the first simulation buffer amplifier and a first port of the second simulation buffer amplifier; the second reference voltage is input to a first input end of the third simulation buffer amplifier, and a second input end of the third simulation buffer amplifier is coupled to the output end of the third simulation buffer amplifier.

2. The data driving circuit of the LCD panel of claim 1, wherein the isolation driving unit is integrated with the data driving chip.

3. The data driving circuit of the LCD panel of claim 1, further comprising a gamma correction circuit, the gamma correction circuit outputs a second reference voltage to a third simulation buffer amplifier.

4. A liquid crystal display (LCD) panel, comprising:

a data driving circuit of the LCD panel;

wherein the data driving circuit of the LCD panel comprises a data driving chip and at least two isolation driving units; the data driving chip comprises a plurality of data driving units that drive data lines of the LCD panel, and the data driving unit comprises a port that limits a range of a working voltage of the data driving unit; each the isolation driving unit outputs a preset reference voltage to the port of the data driving unit;

wherein a driving unit comprises two adjacent data driving units, each of the driving units comprises a first data driving unit having a positive polarity and a second data driving unit having a negative polarity each of the driving units corresponds to one isolation driving unit, and an output end of each of the isolation driving units is coupled to the first port of the first data driving unit and the second port of the second data driving unit;

the data driving circuit of the LCD panel further comprises a first reference voltage, a second reference voltage, and a third reference voltage; a value of the first reference voltage, a value of the second reference voltage, and a value of the third reference voltage successively increase; the value of the second reference voltage is equal to an average value of a sum of the first reference voltage and the third reference voltage; the Preset reference voltage output by the isolation driving unit is the second reference voltage, and the first reference voltage is voltage of a around end of the data driving circuit of the LCD panel;

the first data driving unit comprises a first simulation buffer amplifier, and the second data driving unit comprises a second simulation buffer amplifier; output ends of the first simulation buffer amplifier and the second simulation buffer amplifier are coupled to a switching unit, and the simulation buffer amplifier is coupled to two adjacent data lines through the switching unit; a driving signal of the data line is sent to first input ends of the first simulation buffer amplifier and the second simulation buffer amplifier, a second input end of the first simulation buffer amplifier is coupled to an output end of the first simulation buffer amplifier, and a second input end of the second simulation buffer amplifier is coupled to an output end of the second simulation buffer amplifier;

the isolation driving unit comprises a third simulation buffer amplifier, an output end of the third simulation buffer amplifier is coupled to a second port of the first simulation buffer amplifier and a first port of the second simulation buffer amplifier; the second reference voltage is input to a first input end of the third simulation buffer amplifier, and a second input end of the third simulation buffer amplifier is coupled to the output end of the third simulation buffer amplifier.

5. The LCD panel of claim 4, wherein the isolation driving unit is integrated with the data driving chip.

6. The LCD panel of claim 4, wherein the data driving circuit of the LCD panel further comprises a gamma correction circuit, the gamma correction circuit outputs the second reference voltage to the third simulation buffer amplifier.

7. A liquid crystal display (LCD) device, comprising:

an LCD panel;

wherein the LCD panel comprises a data driving circuit of the LCD panel, the data driving circuit of the LCD panel comprises a data driving chip and at least two isolation driving units; the data driving chip comprises a plurality of data driving units that drive data lines of the LCD panel, and the data driving unit comprises a port that limits a range of a working voltage of the data driving unit; each the isolation driving unit outputs a preset reference voltage to the port of the data driving unit;

wherein a driving unit comprises two adjacent data driving units, each of the driving units comprises a first data driving unit having a positive polarity and a second data driving unit having a negative polarity; each of the driving units corresponds to one isolation driving unit, and an output end of each of the isolation driving units is coupled to the first port of the first data driving unit and the second port of the second data driving unit;

the data driving circuit of the LCD panel further comprises a first reference voltage, a second reference voltage, and a third reference voltage; a value of the first reference voltage, a value of the second reference voltage, and a value of the third reference voltage successively increase; the value of the second reference voltage is equal to an average value of a sum of the first reference voltage and the third reference voltage; the preset reference voltage output by the isolation driving unit is the second reference voltage, and the first reference voltage is voltage of around end of the data driving circuit of the LCD panel;

the first data driving unit comprises a first simulation buffer amplifier, and the second data driving unit comprises a second simulation buffer amplifier; output ends of the first simulation buffer amplifier and the second simulation buffer amplifier are coupled to a switching unit, and the simulation buffer amplifier is coupled to two adjacent data lines through the switching unit; a driving signal of the data line is sent to first input ends of the first simulation buffer amplifier and the second simulation buffer amplifier, a second input end of the first simulation buffer amplifier is coupled to an output end of the first simulation buffer amplifier, and a second input end of the second simulation buffer amplifier is coupled to an output end of the second simulation buffer amplifier;

the isolation driving unit comprises a third simulation buffer amplifier, an output end of the third simulation buffer amplifier is coupled to a second port of the first simulation buffer amplifier and a first port of the second simulation buffer amplifier; the second reference voltage is input to a first input end of the third simulation buffer amplifier, and a second input end of the third simulation buffer amplifier is coupled to the output end of the third simulation buffer amplifier.

8. The LCD panel of claim 7, wherein the isolation driving unit is integrated with the data driving chip.

9. The LCD panel of claim 7, wherein the data driving circuit of the LCD panel further comprises a gamma correction circuit, the gamma correction circuit outputs the second reference voltage to the third simulation buffer amplifier.

* * * * *